US010207292B2

(12) United States Patent
Kostrubiak

(10) Patent No.: US 10,207,292 B2
(45) Date of Patent: Feb. 19, 2019

(54) AERODYNAMIC RECIRCULATING BULK MATERIAL SEPARATOR

(71) Applicant: Olena Kostrubiak, Kharkov (UA)

(72) Inventor: Olena Kostrubiak, Kharkov (UA)

( * ) Notice: Subject to any disclaimer, the term of this patent is extended or adjusted under 35 U.S.C. 154(b) by 0 days.

(21) Appl. No.: 15/576,715

(22) PCT Filed: May 24, 2016

(86) PCT No.: PCT/UA2016/000062
§ 371 (c)(1),
(2) Date: Nov. 23, 2017

(87) PCT Pub. No.: WO2016/190835
PCT Pub. Date: Dec. 1, 2016

(65) Prior Publication Data

US 2018/0161820 A1 Jun. 14, 2018

(30) Foreign Application Priority Data

May 25, 2015 (UA) ..... 2015 05132

(51) Int. Cl.
*B07B 9/02* (2006.01)
*B07B 4/02* (2006.01)
(Continued)

(52) U.S. Cl.
CPC ..... *B07B 4/02* (2013.01); *B03B 4/06* (2013.01); *B07B 7/086* (2013.01); *B07B 9/02* (2013.01)

(58) Field of Classification Search
CPC ..... B07B 4/02; B07B 4/025; B07B 7/086; B07B 7/10; B07B 9/02
See application file for complete search history.

(56) References Cited

U.S. PATENT DOCUMENTS 1,420,593 A 6/1922 Titchmarsh
3,010,576 A * 11/1961 Harte ..... A24B 5/10 209/10
(Continued)

FOREIGN PATENT DOCUMENTS

GB 2078553 A * 1/1982 ..... B07B 7/0865
RU 2194580 C2 6/2002
(Continued)

OTHER PUBLICATIONS

International Search Report dated Oct. 20, 2016 in corresponding Application No. PCT/UA2016/000062, 3 pgs.
(Continued)

*Primary Examiner* — Joseph C Rodriguez
(74) *Attorney, Agent, or Firm* — Max Kaganov, PA

(57) ABSTRACT

An aerodynamic recirculating separator of bulk materials that includes an air blower capable of forming an air stream, an outlet stream directing means, a separation chamber including two inlets and two outlets, a loading hopper, at least one discharge channel, a return air duct including a plurality of turning portions, and at least one residue collection chamber. An outlet of the air blower connects to the first inlet of the separation chamber, an outlet of the loading hopper connects to the second inlet of the separation chamber, the first outlet of the separation chamber connects to the return air duct, and the second outlet of the separation chamber connects to the at least one discharge channel. The air blower, the separation chamber, and the return air duct are consecutively connected so as to form a recirculation channel. The separator forms a material particle flow from the loading hopper to the separation chamber, to distribute commercial particles by their aerodynamic parameters in the separation chamber as the commercial particles fall from the loading hopper and are blown by the air stream formed by the air blower, and to remove the commercial particles
(Continued)

primary air stream
concurrent air streams
commercial fractions
pollutants through the at least one discharge channel. The separator forces remaining material particles into the at least one horizontally flared portion, directs at least a part of the remaining material particles into a residue collection chamber by way of gravity, and injects air into the separation chamber via the discharge channels. The first downstream horizontally flared portion includes a downwardly curved bottom wall and an opening in communication with said flared portion and the external environment. The opening is disposed in a smooth turn zone from said flared portion to the first of the plurality of turning portions, which has an upward turn.

16 Claims, 1 Drawing Sheet

(51) Int. Cl.
*B07B 7/086* (2006.01)
*B03B 4/06* (2006.01)

(56) References Cited

U.S. PATENT DOCUMENTS 3,608,716 A * 9/1971 Rowell ..... A24B 5/10 209/139.1
3,878,091 A * 4/1975 Hukki ..... B07B 7/08 209/135
4,248,699 A * 2/1981 Hukki ..... B07B 7/086 209/154
4,465,194 A * 8/1984 Coleman ..... A24B 5/10 209/138
4,701,256 A * 10/1987 Cross, Jr. ..... A24B 5/10 131/312
4,784,756 A * 11/1988 Ovaskainen ..... B07B 7/08 209/154
4,801,374 A * 1/1989 Harold ..... B07B 4/02 209/135
5,358,122 A * 10/1994 Surtees ..... A24B 5/10 131/312
5,427,248 A * 6/1995 Levy ..... A24B 5/10 209/137
6,845,867 B2 * 1/2005 Sussegger ..... B07B 4/04 209/135
8,016,117 B2 * 9/2011 Althouse ..... B07B 4/02 209/139.1
9,061,321 B2 * 6/2015 Kosilov ..... B07B 4/02

FOREIGN PATENT DOCUMENTS

RU 2278745 C1 6/2006
SU 1074612 A 2/1984
UA 74522 U 10/2012

OTHER PUBLICATIONS

Written Opinion of the International Searching Authority dated Oct. 20, 2016 in corresponding Application No. PCT/UA2016/000062, 4 pgs.

* cited by examiner

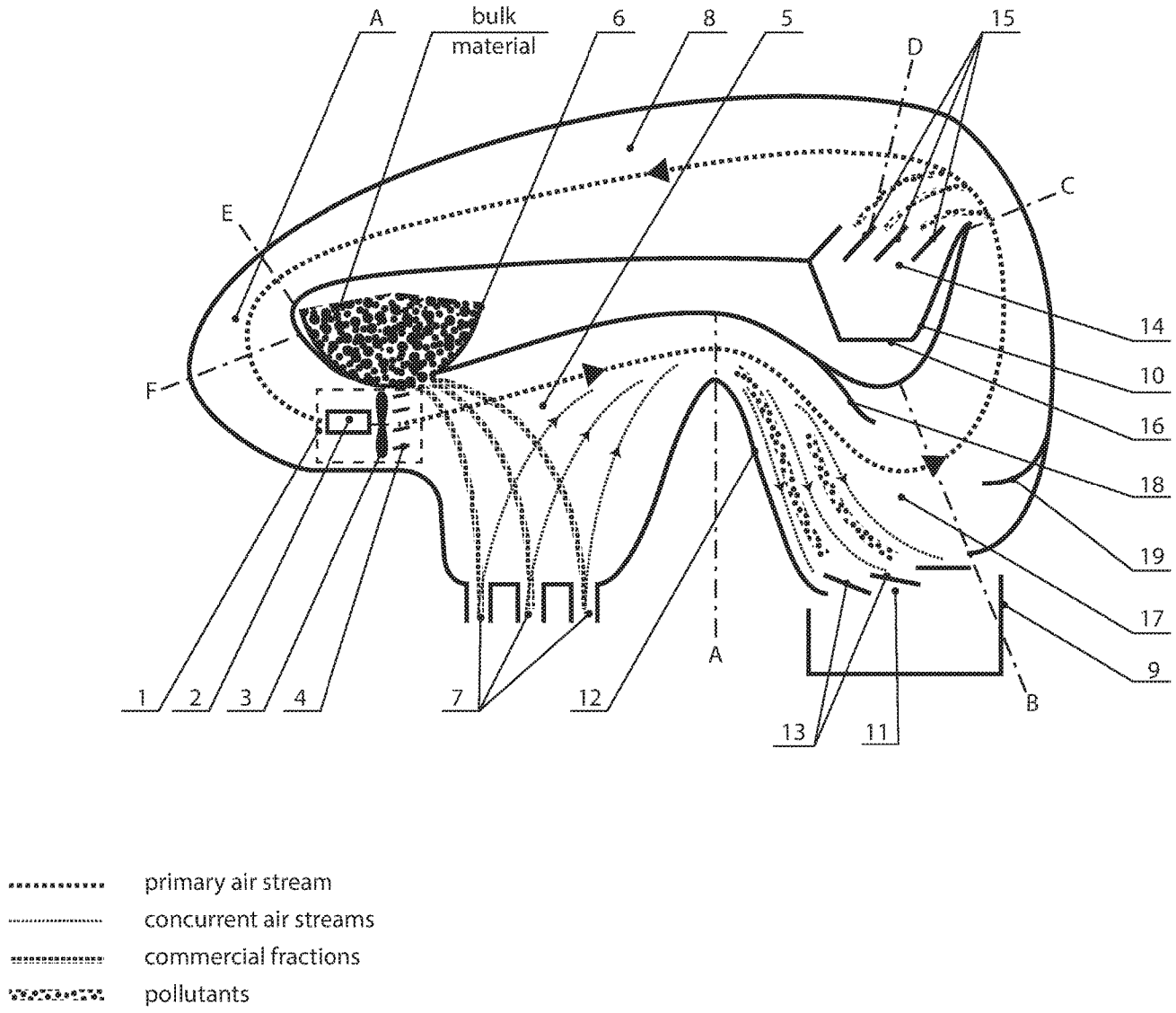
A
bulk material
6
8
5
15
D
C
14
10
16
18
19
17
9
B
11
13
12
A
7
4
3
2
1
F
E
primary air stream
concurrent air streams
commercial fractions
pollutants

AERODYNAMIC RECIRCULATING BULK MATERIAL SEPARATOR

BACKGROUND

The present invention relates to the bulk material handling technology, particularly to the separation of the commercial part of the material and removal of the pollutant part of the material from the air, and may find various industrial and agricultural applications, e.g. handling of the grain products.

The bulk material as dwelt upon herein consists of the solid particles differing by mass, size, shape and optionally constituting the substances. Some particles meet the commercial requirements (the commercial part), whereas the other particles are the pollutants (the pollutant part), and both the commercial part and the pollutant part may in turn include several various fractions differing in particle parameter ranges.

The existing bulk material separators not only separate the commercial particles into fractions, but also remove the pollutant particles from the air by directing them to the special tanks, hereinafter the residue collection chambers.

Multiple devices are known that both simply purify the bulk materials from the pollutants and separate the commercial part of the bulk material removing the pollutant part of the material from the air simultaneously.

By the principle of the operation such devices may be divided into the screen type which separate fractions on screens according to particle size, and the aerodynamic type where the particle flow is blown with the air and the fractions are separated according to their aerodynamic characteristics.

The aerodynamic devices are divided by the air stream passage type into the direct-flow type where an air blower takes the external air and then exhausts the air purified to the various degrees into the environment, and the recirculation type where at least part of the air is recycled to the air blower inlet.

The present invention relates just to the aerodynamic recirculating separator of the bulk materials.

In general, in the aerodynamic devices where a gas stream is created, the particle moving in the gas stream is acted as effected by gravity and under the influence of force developed by the air motion (hereinafter the air effective force) which is proportional to the square of flow velocity and air density at given point and depends on a particle maximum section area. If the gravity force is substantially larger than the air effective force, the latter may only deflect the particles from their vertical direction. If the air effective force is substantially larger than the gravity force, the particles soar in the air without descending. The particles are characterized by the minimum soaring velocity in the given air stream, i.e. the minimum air stream velocity at which particles of a certain shape and mass begin soaring.

The separation process, i.e. the separation of the commercial-size particles into fractions, takes place at the separation chamber and consists in development of the air stream by the blower which velocity is substantially lower than the soaring velocity of the commercial-size particles and, eventually, of some heavy fractions of the pollutant particles, but this velocity is sufficient to deflect the commercial-size particles of a target fraction from the vertical direction by prescribed distance under the free fall from the specified height and exceeds the soaring velocity of light fractions.

It must be noted that the air blower capacity and the air stream parameters (density, velocity and shape) at the separation chamber must be defined exclusively by the parameters of the bulk material to be purified, namely, by size, mass and shape distribution of the commercial particles. More particularly, the main requirement in formation of the air stream coming into the separation chamber is the necessary deflection degree of the useful, i.e. commercial, particles under their fall from the loading hopper so that they got to the discharge channels. Meanwhile, the particles which did not get to the discharge channels must be carried by the air stream away from the separation chamber and removed somewhere else. In this connection, for instance, the cyclones are not advisable for the polluted air cleaning in the recirculating separators, as they require much higher the air stream velocity and/or air blower capacity than it is necessary for the aerodynamic separation per se.

Another important aspect of the recirculating separator is the fact that a high degree of air purification must be ensured within one recurring cycle, so that as few as possible pollutant particles returned to the separation chamber via the air blower, so that they did not deposit on the air blower movable parts and on the air duct walls, thus hampering the device operation and deteriorating its efficiency and the other operational parameters.

The closest prior art solution to that presented in this invention is described in Russian Federation Patent No 2194580, publication date 26 Dec. 2002. The grain cleaner for cleaning and fractionation of the grain materials according to this patent comprises the receptacle, the closed air system with a cross-flow fan, the loading window, the air duct and the residue collection chamber, wherein the receptacle includes the feeder, the cross-flow fan pressure nozzle is mated via the controllable feeder lip screen to the inclined air separator channel having on its top wall the loading window and in the bottom part opposite to the loading window the reception tanks for grain material separation products with the rotary planes fixed on hinges to their walls, whereas the cross-flow fan sucking window is mated to the feeder via the lip screen and to the dischargers of the grain material separation product reception tanks via the dust deflecting channel formed by the wall congruent to the fan shell wall.

The disadvantages of this prior art are the high air pollution at the cross-flow fan (air blower) inlet which increases a probability of the non-commercial material particle sticking to the fan movable parts, its imbalance and eventual failure. Especially hazardous in this respect are the sticky bulk materials, e. g. the sunflower seeds.

Then, in this cleaner device the dust is sucked off from the separation product reception tanks along the narrow dust deflecting channel mated with the fan. On a par with the increased air pollution degree at the fan inlet and the unsatisfactory cleaning at the outlet of the separation product reception tanks, it also adds to the environment pollution, as an excess air coming into the dust deflecting channel is exhausted to the environment, mostly with the commercial fractions of material through the separation product reception tanks and/or through the feeder.

SUMMARY

Thus, the objective of the present invention is to provide the recirculating separator of the bulk materials which, simultaneously with the high separation degree of the material commercial part and its distinct fractionation, would secure the high air cleaning degree within the return air duct itself, that is, the removal of the material polluting part within one air circulation cycle.

This objective is solved by the aerodynamic recirculating separator of the bulk materials comprising the air blower capable for forming the air stream with the outlet air stream directing means, the separation chamber with two inlets and two outlets, the loading hopper, at least one discharge channel, the return air duct with a number of turning portions and at least one residue collection chamber, wherein the air blower outlet is mated to the separation chamber first inlet, the loading hopper outlet is mated to the separation chamber second inlet, the separation chamber first outlet is mated to the return air duct, the separation chamber second outlet is mated to each of at least one discharge channels, whilst consecutively mated the air blower, the separation chamber and the return air duct form the recirculation channel, the separator being capable for forming the material particle flow from the loading hopper to the separation chamber, the distribution of commercial particles by their aerodynamic characteristics at the separation chamber when they fall down from the loading hopper and are blown by the air stream formed by the air blower and removing the commercial particles through the discharge channel, the return air duct includes at least one horizontally flared portion to which one of the said residue collection chambers is connected via the opening in the air duct bottom wall, whereas the separator is capable for forcing in the remaining material particles into the said horizontally flared portions and directing at least part of the remaining material particles into the residue collection chambers effected by gravity, the following improvements have been introduced:

- the separator is made capable for the air injection to the separation chamber via the discharge channels;
- the first downstream residue collection chamber has the downwardly curved bottom wall;
- the residue collection chamber opening with which it is connected lies in the smooth turn zone from the said horizontally flared portion to the first of the said turning portions having an upward turn;
- and this opening is the only one opening of the return air duct being in the permanent communication with the environment.

The underlying table shows the correlation between certain different terms applied in this description and in the prior art description.

| Term in RF U.S. Pat. No. 2,194,580 | Term in the present description |
|---|---|
| A grain cleaner for cleaning and fractionation of grain materials | An aerodynamic recirculating separator of bulk materials |
| A feeder | A loading hopper |
| A closed air system | A recirculation channel |
| A cross-flow fan | An air blower |
| A lip screen | Stream directing means |
| An air separation channel | A separation chamber |
| Grain material separation product separation tanks | Discharge channels |

In this description "the horizontally flared portion" means the portion where the motion direction of the particles forced in therein has a horizontal component to enable their subsequent deposition into the residue collection chamber which lies downwards and with which the said portion is connected.

As different from the prior art where a part of the air exits via the discharge channels or the loading hopper and the air is unsatisfactorily sucked off from the discharge channels to the separate channel mated to the air blower inlet via the openings in the lateral walls of the discharge channels, in the proposed separator the air is injected to the separation chamber, that is to the main stream in the air duct, which enables the efficient cleaning mechanism for the commercial fractions falling to the discharge channels, by means of the light particles that get therein being entrained by the oppositely directed air stream. This ensures the improved quality of the material commercial fractions cleaning.

Subsequently, as well as in the prior art, both the density and the velocity of the air stream at the horizontally flared portions diminish, and in the proposed separator the portion flaring degree is so selected that the most particles would stop soaring and fall to the first residue collection chamber. This is also favored by the fact that the first residue collection chamber is in the permanent communication with the environment, because, on the contrary to the prior art, where an excess air getting to the air duct from the deflecting channel is pushed outside via the discharge channels, in the proposed separator the excess air injected to the discharge channels comes outside via the opening to the first downstream residue collection chamber. Thus, the non-commercial particles are shoved by this stream to the residue collection chamber. This substantially reduces the pollution (dust content) in the air flowing to the next air duct portions and, thus, at the air blower suction side, at its pressurization side, at the separation chamber inlet and in the discharge channels. As a result, the polluting particles become less prone to be deposited on these parts of the air duct. We must note that the similar device does not require that the most part of the particles to be deposited to the first residue collection chamber at all as a priori the polluted air comes to the air blower inlet from the loading hopper and the discharge channels. Therefore, after some time after the beginning of the operation the device attains the dynamic condition when the whole air stream in the air duct is permanently polluted with the non-commercial particles and some more or less constant part of them gets to the residue collection chamber.

Besides, due to the bottom wall of the said first horizontally flared portion being downwardly curved and due to the presence of the smooth turn zone from the said portion to the first of the said turning portions having an upward turn, the air stream in this zone is reversed, and the non-commercial fractions which are moving downwards but still soaring may due to inertia get to the residue collection chamber opening, thus, the cyclone-like system appears.

It must be noted that these improvements ensure not only the efficient collection of the bulk of pollution (up to 85%) at the first residue collection chamber, thus increasing the air cleaning degree in the return air duct after the residue collection chamber, but also enable a slow deposition of the pollutants within the first residue collection chamber so that they practically may not get to the ambient atmosphere. This is attained by the sufficient stream expansion at the first horizontally flared portion, the sufficient dimension of the opening itself and the smooth changing air stream direction in the zone of the first residue collection chamber, so that air stream velocity through the air duct opening becomes less than the soaring velocity of the most particles moving within the residue collection chamber.

Another advantage of the design with the horizontally flared portion having downwardly curved bottom wall is the fact that this portion may act as an additional separation chamber, that is, may separate the particles with the different aerodynamic characteristics getting to the said smooth turn zone, and, thus, the residue collection chamber may have several openings and may collect the different non-commercial particles at the different places, isolating in this fashion the particles which are non-commercial for the bulk material under treatment, but useful for the other purposes.

Thus, due to the introduced improvements the air dust content at the return air duct and, consequently, the probability of polluting particles deposition on the air blower moving parts, is reduced, and this improves the operational characteristics of the separator, particularly, diminishes the time between cases of the maintenance, improves quality of commercial particles cleaning, as the light polluting particles getting to the discharge channels are entrained by the injected air into the main air stream.

In one embodiment of the separator according to the invention the stream directing means is made capable for setting the direction, having a component acting away from the discharge channels, on the contrary to the known grain cleaner, where the main air stream is directed towards the discharge channels and the air is sucked just from the discharge channels and is returned to the air blower. Availability of the dynamic pressure in this stream causing the static pressure to be lower than the atmospheric pressure, and the stream directed away from the discharge channels enable the air injection from the external environment to the discharge channels and further to the main air stream.

It should be noted that the air may be injected via the discharge channels in some other ways, for instance, by the forced pressurization or suction, but the above described procedure is the most efficient and low-cost.

In one embodiment of the proposed separator the stream directing means at the air blower outlet is the louver screen ensuring the most uniform distribution of the incline of the angle of the stream along its height.

One more improvement in the separator according to the invention consists in the row of vanes attached to the opening which connects the air duct with the first residue collection chambers and installed against the air stream. As this opening lies in the zone of the air stream direction change, the polluting particles move in general downwards and are shoved by the air stream changing its direction from generally downwards in the first horizontally flared portion to generally upwards at the first turning portion having an upward turn, moreover in addition the particles, similar to the cyclone process, due to inertia get under the said vanes and then continue the movement with the said air excess to the residue collection chamber.

The specific embodiment of the separator according to the invention which substantially improves the air cleaning degree is, the separator which comprises at least two residue collection chambers and two horizontally flared portions, wherein the downstream second residue collection chamber lies in the zone of the downstream second horizontally flared portion and all residue collection chambers, except the downstream first one, are equipped with the dumping means capable for the temporary opening.

In this case polluting particles that remained after the passing the first turning portion having an upward turn and still soaring, are shoved to the second horizontally flared portion. As the latter is capable for adding the horizontal component to the stream, the particles follow that stream, the air effective force diminishes due to the portion flaring, so they stop soaring and descend to the residue collection chamber effected by gravity. The residue collection chambers being equipped with the dumping means capable for the temporary opening to block the communication with the external environment ensure the stable process running, excluding an eventual air suction through the residue collection chambers, which would totally hamper the deposition of the particles into the residue collection chamber and in general would disturb the normal separation working process, including as high as possible deposition of the polluting particles into the first residue collection chamber.

In the specific embodiment of the separator according to the invention comprising more than one residue collection chamber, the dumping means capable for the temporary opening are the valves capable for opening under the effect of weight of the bulk material accumulated therein. After the residue collection chamber dumping the said valve must quickly close again to block said communication with the external environment.

Further improvement of the separator according to the invention provides the installation of the top and the bottom air splitters. The top splitter is placed at the inlet part of the first horizontally flared portion, at the opposite side of the first residue collection chamber, is directed co-current with the air stream and is capable for deflecting its blowing stream to the portion inside zone. The bottom splitter is installed at the first turning portion having an upward turn at the side of the opening into the next downstream first residue collection chamber and directed against the flow to the stream. The first splitter presses the air stream downwards. The second splitter serves, particularly, to retard the air stream at the zone between the splitter and the air duct surface, so to enable the particles coming under it to descend downwards to the residue collection chamber effected by gravity.

As the volume of air injected via the discharge channels goes outside through the first residue collection chamber in the return air duct, a boundary line appears downstream after the residue collection chamber between the pressurization zone and the exhaustion zone where the pressure is below atmospheric one. In the best embodiment the said splitters must be installed just along this boundary line, its position being determined empirically or by the calculation and depends, particularly, on the location and the shape of the splitters themselves.

The availability of the second residue collection chamber in the separator according to the invention makes possible and feasible such an improvement as a narrowing at the end of the first turning portion having an upward turn and which favors throwing the light soaring particles up to the next horizontally flared portion, thus adding a horizontal component to their flow direction and enabling the deposition into the second residue collection chamber.

To increase universality and improve operational characteristics of the separator according to the invention each discharge channel may comprise two pipelines interconnected in their inlets, ending at the opposite sides of the separator and equipped with the gates capable for blocking thereof. This enables a selection of the place for the material commercial fractions collections, to unite or divide them, etc.

In the simplest embodiment of the separator claimed for any above options the first residue collection chamber may be made as a container disposed under the air duct opening.

In another particular embodiment the separator according to the invention comprises at least two discharge channels, whereas in one modification the downstream last discharge channel serves to remove the polluting particles which are less heavy than the commercial particles, whereas in another modification the downstream first discharge channel serves to remove the non-commercial particles which are heavier than the commercial particles. Thus, the separator in accordance with the invention becomes more universal.

The most energy-sparing solution for the separator according to the invention is application of an axial fan as the air blower, enabling, particularly, to control its rotation frequency with corresponding means.

In a special embodiment of the separator according to the invention equipped with the axial fan as the air blower, the fan rotation frequency controller is a frequency converter which enables smooth start and stoppage of the fan motor and the efficient control of its power and rotation velocity.

As the separator according to the invention has reached the above technical results, an opportunity arises to equip the separator with an independent bulk material supply means, e.g. inclined a conveyor with the horizontal bulk material pick-up from the ground stack, wherein due to a sufficiently compact design ensured by the separator recirculation type, the separator may be forcibly or independently moved over ground, for instance, with the help of wheels. Moreover, due to the high air cleaning degree within the separator and, thus, the insignificant polluted air exhaust from the first residue collection chamber, such separator may be applied even at the closed premises, e.g. the closed thrashing floor.

The separator in accordance with the invention in all above embodiments may be equipped with the discharge conveyor which inlet is connected to the outlets of at least some discharge channels to ensure the collection of the commercial fractions at the necessary place, for example, the truck body. Such conveyor may be capable for rotation around the vertical axis in its inlet part and/or capable for changing the angle of incline relative to the horizontal plane, thus permitting to deliver the various fractions to the different heights and in the different directions, increasing in this way universality of the separator according to the invention.

The aerodynamic recirculating separator according to the invention is described below in more details with the reference to the FIGURE of drawing, which in any way does not limit the scope of legal protection as claimed by the applicant and serves exclusively as an example of embodiment of this device.

BRIEF DESCRIPTION OF THE FIGURES

The FIGURE is a schematic depiction of the front view of the aerodynamic recirculating separator of bulk materials according to the invention, with the air duct front wall being removed.

DETAILED DESCRIPTION

The aerodynamic recirculating separator of bulk materials according to the invention, as presented in the FIGURE, comprises the air blower 1 outlined with a dash line and including the drive motor 2, the impeller 3 installed in the tube which together form the axial impeller-type fan, and the stream directing means at the outlet in the form of the louver screen 4, the separation chamber 5 with two inlets and two outlets, the loading hopper 6, three discharge channels 7, the return air duct 8 with a number of turning portions and, finally, the first 9 and the second 10 residue collection chambers. The air blower 1 outlet is mated with the separation chamber 5 first inlet, an outlet of loading hopper 6 is mated to the separation chamber 5 second inlet, the separation chamber 5 first outlet is mated with the return air duct 8, whereas its second outlet is mated with each of the discharge channels 7. Consecutively mated the air blower 1, the separation chamber 5 and the return air duct 8 together form a channel where the air stream circulates (recirculation channel). The return air duct 8 is divided into several portions, their boundaries being defined by projections of planes in the form of dash-dotted lines specified with Latin letters. So, the return air duct 8 comprises at least one horizontally flared portion A-B, which is connected with the first residue collection chamber 9 via the opening 11 in the bottom wall of the air duct 8. To ensure the air stream recirculation flow, the part of the turning portions has turns in the vertical plane. Such portions in the FIGURE are, for instance, portions B-C, C-D, E-F. The separation chamber 5 is capable for the air injection via the discharge channels at the expense of the air stream being directed upwards, away from the discharge channels. The downstream first horizontally flared portion A-B has the downwardly curved bottom wall 12, whereas the opening 11 to the residue collection chamber lies in a smooth turn zone from this portion up to the first of the said turning portions having an upward turn B-C, and it is the only opening in the return air duct 8 which has the permanent communication with the external environment. The opening 11 is covered with several vanes 13 directed opposite to the air stream flow. The opening 14 to the second residue collection chamber 10 is covered by several vanes 15. At the bottom of the second residue collection chamber the dumping means is made as the valve 16. At the inlet part of the first horizontally flared portion A-B at the side opposite to the residue collection chamber 9 the top air splitter 18 is installed directed along the stream flow, whereas at the first turning portion having an upward turn B-C, at the side of opening to the first residue collection chamber 9, directly downstream after this opening the second air splitter 19 is installed which is directed against stream flow.

The device operates as follows. The air blower 1 forms the air stream in the return air duct 8 which central part is depicted in the FIGURE with a heavy dot short-dashed line, the said air stream being directed by the lip screen inclined to the horizontal plane, away from the discharge channels 7. The bulk material to be cleaned and separated comes from the bottom outlet of the loading hopper 6 to the separation chamber 5, where it is blown with the said air stream, so that the heavy particles of the bulk material fall down effected by gravity and, depending on their aerodynamic characteristics, deflect under different angles from the vertical trajectory and correspondingly get to the different discharge channels as different commercial or heavy non-commercial fractions. As the air stream is directed to the opposite side from the discharge channels, the air is injected via the latter to the main air stream, and these streams are depicted with the thin short-dash lines. The velocity of these streams is insufficient to cause the soaring of the heavy particles directed to the discharge channels 7, but it is sufficient to enable soar the light particles entrained by them. In this way the high cleaning degree of the material commercial fractions is attained.

After that the light soaring particles getting to the air stream from both the loading hopper and from the discharge channels get to the horizontally flared portion A-B where the velocity of the stream and, thus, of the particles is so reduced that the most particles stop soaring. As the portion A-B bottom wall 12 is downwardly curved, the adjacent parts of the portions A-B and B-C form the indentation 17 wherein the non-commercial particles fall; they are pushed by the air, change the motion direction from quasi-vertical to quasi-horizontal and partly due to their inertia, as in the cyclone, get under the vanes 13 to the opening 11 and are removed from the air duct to the first residue collection chamber 9. The said indentation 17 with the vanes 13, the opening 11 and the residue collection chamber 9 will be hereinafter described as a cyclone-residue collection chamber.

The top air splitter 18 presses the air stream in the direction of the cyclone-residue collection chamber, whereas the bottom air splitter 19 brakes the air stream at the zone between it and the air duct wall, thus slowing the particles velocity so that they stop soaring and return to the opening 11. The shape and the location of the air splitters 18 and 19 should be selected by the experimental way or calculated so that the conditional border line between the pressurization zone and the exhaustion zone pass nearby, preferably through the splitters. In this case second and downstream subsequent (if any) residue collection chambers would lie just in the exhaustion zone.

The necessary condition for a reduced pollution outcome from the cyclone-residue collection chamber to the environment is a relatively low velocity of the air stream and the particles in the opening 11. Practice shows that said velocity should not exceed 2 m/s, what is quite attainable in the proposed design of the cyclone-residue collection chamber for all kinds of bulk grain materials and the other bulk materials of the similar density.

Then the air stream moves along the turning portion having an upward turn B-C where due to its narrowing stream velocity increases and the particles are injected forced in into the horizontally flared portion C-D. Being effected by the gravity force the non-commercial particles still remaining in this stream fall down under the vanes 15 and get to the second residue collection chamber 10. When the mass of accumulated particles at the second residue collection chamber 10 exceeds the prescribed value, a valve 16 under the pressure of this mass opens downwards, and accumulated particles are removed from the second residue collection chamber, after what the valve 16 quickly closes.

Actually cleaned from the pollution the air stream continues further along the return air duct 8 and arrives in the air blower 1 inlet, and then the cycle is repeated.

If necessary, the additional residue collection chambers may be installed downstream in the return air duct 8, for instance, after the portion D-E.

For the treatment of some special bulk material the downstream first discharge channels 7 may be assigned for the separation of the non-commercial fractions which are heavier than the commercial fractions. In another case the downstream last discharge channels 7 may be assigned for the separation of the non-commercial fractions which are lighter than the commercial fractions but have the soaring velocity substantially higher than the air stream velocity in this zone.

The number of the discharge channels depends on the type of the bulk material to be treated. But to ensure the separator universality their number must be at least three to enable the separation of the commercial fractions by their quality depending on dynamic characteristics of the particles.

Instead of the louver screen 4 the guiding nozzles may be applied as the stream directing means.

The discharge channels serve, particularly, to direct the extracted fractions to their collecting grounds. For this purpose each channel is equipped with two pipelines mated in their inlets (not shown), whereas their outlets end in the opposite parts of the separator and are equipped with the gates capable for closing. Thus, for instance, the commercial fractions may be directed to one side of the separator and the non-commercial fractions to the opposite side. If the separator is fixed, these fractions may be picked up by the corresponding means, for example, the conveyors. In case of movable, e.g., a wheeled separator the fractions may be collected into stacks and then picked up. Preferably the separator according to the invention may be equipped with a discharge conveyor which inlet is mated with the outlets of at least some discharge channels to enable the commercial fractions being collected at the necessary place, e.g. truck body. Such conveyor may be capable for rotation around the vertical axis in its inlet part and/or capable for changing angle of the incline relative to the horizontal plane, thus enabling the loading the commercial fractions to the different heights and in different directions, what substantially increases the universality of the separator according to the invention.

The separator according to the invention may be also equipped with means for supply of the bulk material to the loading hopper, e.g. an inclined conveyor with the horizontal pickup of the bulk material disposed, e.g. on the ground.

The first residue collection chamber 9 may be made as a removable container installed under the opening 11 in the air duct, preferably at the minimum distance from it, but sufficient for unhindered the air outcome therefrom.

The air blower 1 in the form of an axial fan ensures the motor rotation frequency control with a frequency converter (not shown) which would be difficult in case of the centrifugal fan, considering first of all the motor cooling conditions. Such control is necessary in the case of the separator setup according to characteristics of the special bulk material.

Thus, the aerodynamic recirculating separator of the bulk materials have been developed wherein due to described improvements the quality of cleaning of the extracted material fractions is increased, due to the deeper air cleaning within the separator its operational parameters are improved, e.g. service life and time between maintenance checks, separator control is simplified and better conditions appear for the deeper cleaning of the air exhausted to the environment, thus expanding the separator application opportunities.

The invention claimed is:

1. An aerodynamic recirculating separator of bulk materials, comprising:

an air blower capable of forming an air stream and including an outlet stream directing means;

a separation chamber including a first inlet, a second inlet, a first outlet and a second outlet;

a loading hopper;

at least one discharge channel;

a return air duct including a plurality of turning portions; and at least one residue collection chamber;

wherein an outlet of the air blower is mated to the first inlet of the separation chamber;

an outlet of the loading hopper is mated to the second inlet of the separation chamber;

the first outlet of the separation chamber is mated to the return air duct;

the second outlet of the separation chamber is mated to the at least one discharge channel;

the air blower, the separation chamber, and the return air duct are consecutively mated so as to form a recirculation channel;

the separator is capable of forming a material particle flow from the loading hopper to the separation chamber, distributing commercial particles by their aerodynamic parameters in the separation chamber as the commercial particles fall from the loading hopper and are blown by the air stream formed by the air blower, and removing the commercial particles through the at least one discharge channel;

the return air duct includes at least one horizontally flared portion, in communication with at least one residue collection chamber via an opening in a bottom wall of the return air duct;

the separator is capable of forcing remaining material particles into the horizontally flared portion and directing at least a part of the remaining material particles into the at least one residue collection chamber by way of gravity;

wherein the separator is capable of injecting air into the separation chamber via the at least one discharge channel;

the first downstream horizontally flared portion includes a downwardly curved bottom wall between the beginning of the first downstream horizontally flared portion and the opening of the first downstream horizontally flared portion;

the opening of the first downstream horizontally flared portion is disposed in a smooth turn zone from the first downstream horizontally flared portion to the first of the plurality of turning portions, the first of the plurality of turning portions having an upward turn; and the opening of the first downstream horizontally flared portion is the only opening of the return air duct that is in permanent communication with the external environment.

2. The separator of claim 1, wherein the outlet stream directing means is capable of setting a direction having a component directed away from the at least one discharge channel.

3. The separator of claim 1, wherein the outlet stream directing means comprises a louver screen.

4. The separator of claim 1, wherein the opening of the first downstream horizontally flared portion is covered by a plurality of vanes directed opposite to the air stream.

5. The separator of claim 1, further comprising:

at least two residue collection chambers; and at least two horizontally flared portions;

wherein a second downstream residue collection chamber lies in the zone of a second downstream horizontally flared portion; and the residue collection chambers, with the exception of the first of the at least two residue collection chambers, include a dumping means adapted for temporary opening.

6. The separator of claim 5, wherein the dumping means comprises valves capable of opening under the effect of the weight of the bulk material accumulated in the corresponding residue collection chamber.

7. The separator of claim 1, further comprising:

a top air splitter, the top air splitter being disposed at the inlet part of the first downstream horizontally flared portion, at the opposite side from the first downstream residue collection chamber, the top air splitter being directed co-current with the air stream and capable of deflecting the air stream to the inside zone of the first downstream horizontally flared portion; and a bottom air splitter, the bottom air splitter being disposed at the first of the plurality of turning portions, the first of the plurality of turning portions having an upward turn, the bottom air splitter being disposed at the side of an opening into a subsequent downstream residue collection chamber, the bottom air splitter being directed against the air stream, and capable of retarding the air stream at the zone between the splitter and the surface of the air duct.

8. The separator of claim 1, wherein the first of the plurality of turning portions is narrowing upwards.

9. The separator of claim 1, wherein:

the at least one discharge channel comprises two pipelines interconnected at their inlets; and the outlets of the pipelines terminate at opposite sides of the separator, and are equipped with gates capable of blocking the outlets.

10. The separator of claim 1, wherein the residue collection chamber in communication with the opening of the first downstream horizontally flared portion comprises a container disposed under the opening.

11. The separator of claim 1, further comprising at least two discharge channels.

12. The separator of claim 11, wherein a last discharge channel of the at least two discharge channels serves to remove pollutant particles that are lighter than commercial particles.

13. The separator of claim 11, wherein a first discharge channel of the at least two discharge channels serves to remove pollutant particles that are heavier than commercial particles.

14. The separator of claim 1, further comprising more than three discharge channels.

15. The separator of claim 1, wherein the air blower comprises an axial fan.

16. The separator of claim 1, wherein a fan rotation frequency controller comprises a frequency converter.

* * * * *